US008436521B2

(12) United States Patent
Shim

(10) Patent No.: US 8,436,521 B2
(45) Date of Patent: May 7, 2013

(54) LAMP DEVICE WITH MAGNETIC SOCKET

(76) Inventor: Henry Hyunbo Shim, Los Angeles, CA (US)

( * ) Notice: Subject to any disclaimer, the term of this patent is extended or adjusted under 35 U.S.C. 154(b) by 269 days.

(21) Appl. No.: 13/052,312

(22) Filed: Mar. 21, 2011

(65) Prior Publication Data

US 2012/0242213 A1 Sep. 27, 2012

(51) Int. Cl.
*H01J 1/00* (2006.01)
*H01J 21/22* (2006.01)
*H01J 35/28* (2006.01)

(52) U.S. Cl.
USPC ..... 313/152; 313/146; 313/574; 313/621; 313/631; 313/491; 362/398; 362/286

(58) Field of Classification Search ..... 313/152, 313/153, 491, 146, 574, 621, 631, 154–159; 362/398, 286
See application file for complete search history.

*Primary Examiner* — Anne Hines
*Assistant Examiner* — Jose M Diaz
(74) *Attorney, Agent, or Firm* — John K. Park; Park Law Firm

(57) ABSTRACT

A lamp device includes a lamp, a socket, two magnetic electrodes, and two electrode boxes. The lamp comprises a bulb portion, a stem portion, and two magnetic contacts. The socket has a receptacle portion configured to accept the lamp. The two magnetic electrodes are disposed in the receptacle portion. Each of the two electrode boxes encloses each of the two magnetic electrodes. The magnetic electrode is free to move in the electrode box, and the magnetic electrode makes an electrical contact all the time. The lamp device may further comprise a guiding groove and an insulating wall. The guiding groove may be provided on a bottom surface of the lamp between the two magnetic contacts.

20 Claims, 6 Drawing Sheets

LAMP DEVICE WITH MAGNETIC SOCKET

BACKGROUND OF THE INVENTION

The present invention relates to a lamp device with magnetic socket. More particularly, this invention relates to a lamp device with magnetic socket, which makes it easy to install and maintain.

Since the lamp has been with people for a long time, it might be considered that the lamp device has been developed fully, leaving nothing to improve.

But, it is not true. Still there are a lot of problems to solve for more convenience. More convenient and easier may be the goals.

Accordingly, a need for a convenient lamp device has been present for a long time considering the wide range of potential application. This invention is directed to satisfy the long-felt need.

SUMMARY OF THE INVENTION

An objective of the invention is to provide a lamp device with magnetic socket.

Another object of the invention is to provide a lamp device with magnetic socket, which can be easily installed.

Still another object of the invention is to provide a lamp device with magnetic socket, which can provide secure electrical contact.

An aspect of the invention provides a lamp device comprising a lamp, a socket, two magnetic electrodes, and two electrode boxes.

The lamp comprises a bulb portion, a stem portion, and two magnetic contacts.

The socket has a receptacle portion configured to accept the lamp.

The two magnetic electrodes are disposed in the receptacle portion.

Each of the two electrode boxes encloses each of the two magnetic electrodes. The magnetic electrode is free to move in the electrode box, and the magnetic electrode makes an electrical contact all the time.

The lamp device may further comprise a guiding groove and an insulating wall.

The guiding groove may be provided on a bottom surface of the lamp between the two magnetic contacts.

The insulating wall may be disposed in a central position between the two magnetic electrodes and configured to fit into the guiding groove.

The guiding groove may divide the bottom surface into two portions from an edge to other edge.

Each of the two magnetic contacts may comprise a contacting surface fitting the corresponding one of the two electrode boxes so as to facilitate electrical contact in-between.

Each of the two electrode boxes may comprise a flat space having an even height.

Each of the two magnetic electrodes may have a height smaller than the height of the flat space in the electrode box.

The lamp device may further comprise two power lines, and each of the two power lines may be electrically connected to corresponding one of two electrode boxes.

The lamp device may further comprise two power lines, and each of the two power lines may be electrically connected to corresponding one of two magnetic electrodes.

The polarity of the two magnetic contacts of the lamp and the two magnetic electrodes may be determined so as to provide a voltage of a predetermined polarity to the lamp.

Each of the two electrode boxes may be non-magnetic and electrically conductive.

Each of the two electrode boxes may be ferromagnetic and electrically conductive.

The lamp device may further comprise one or more male and female locking devices.

The one or more male locking devices may be provided in an inner wall of the receptacle portion.

The one or more female locking devices may be provided on side wall of the lamp.

The lamp may further comprise one or more ventilation holes along contacting surface between the socket.

The stem portion of the lamp and the socket may be circular in cross-section.

The stem portion of the lamp and the socket may be rectangular in cross-section.

Each of the two electrode boxes may further comprise an opening provided on a portion of surface of the electrode box for facilitating attraction and contact between the corresponding magnetic electrode and magnetic contacts.

Each of the two electrode boxes may have a shape of shell, and each of the two magnetic contacts may have a shape of sphere.

Another aspect of the invention provides a lamp device with magnetic socket comprising a lamp, two electrode boxes, two magnetic balls, a socket, and two magnetic contacts.

The lamp comprises a bulb portion and a stem portion.

The two electrode boxes are provided on a bottom surface of the stem portion of the lamp.

Each of the two magnetic electrode balls is disposed movably in a corresponding electrode box. The magnetic electrode balls is free to move in the electrode box, and the magnetic electrode ball makes an electrical contact with the electrode box all the time.

The socket has a receptacle portion configured to accept the lamp.

The two magnetic contacts are provided in the receptacle portion of the socket.

The lamp device may further comprises a guiding groove and an insulating wall.

The guiding groove may be provided on a bottom surface of the stem portion between the two electrode boxes.

The insulating wall may be disposed in a central position between the two magnetic contacts and configured to fit into the guiding groove.

Still another aspect of the invention provides a lamp device with magnetic socket comprising:

a lamp comprising a bulb portion and a stem portion;

two first electrode boxes provided on a bottom surface of the stem portion of the lamp;

two first magnetic electrode balls, each of which being disposed movably in a corresponding first electrode box, wherein the first magnetic electrode ball is free to move in the first electrode box, wherein the first magnetic electrode ball makes an electrical contact with the first electrode box all the time;

a socket having a receptacle portion configured to accept the lamp; and two second electrode boxes provided in the receptacle portion of the socket; and two second magnetic electrode balls, each of which being disposed movably in a corresponding second electrode box, wherein the second magnetic electrode ball is free move in the second electrode box, wherein the second magnetic electrode ball makes an electrical contact with the second electrode box all the time.

One of the first and second electrode boxes may comprise an opening provided on a portion of the surface of the electrode box.

The advantages of the present invention are: (1) the lamp device enables to install the lamp conveniently; (2) the lamp device makes the electrical contact secure; and (3) the lamp device gives flexibility to the socket design.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

Figure 1:
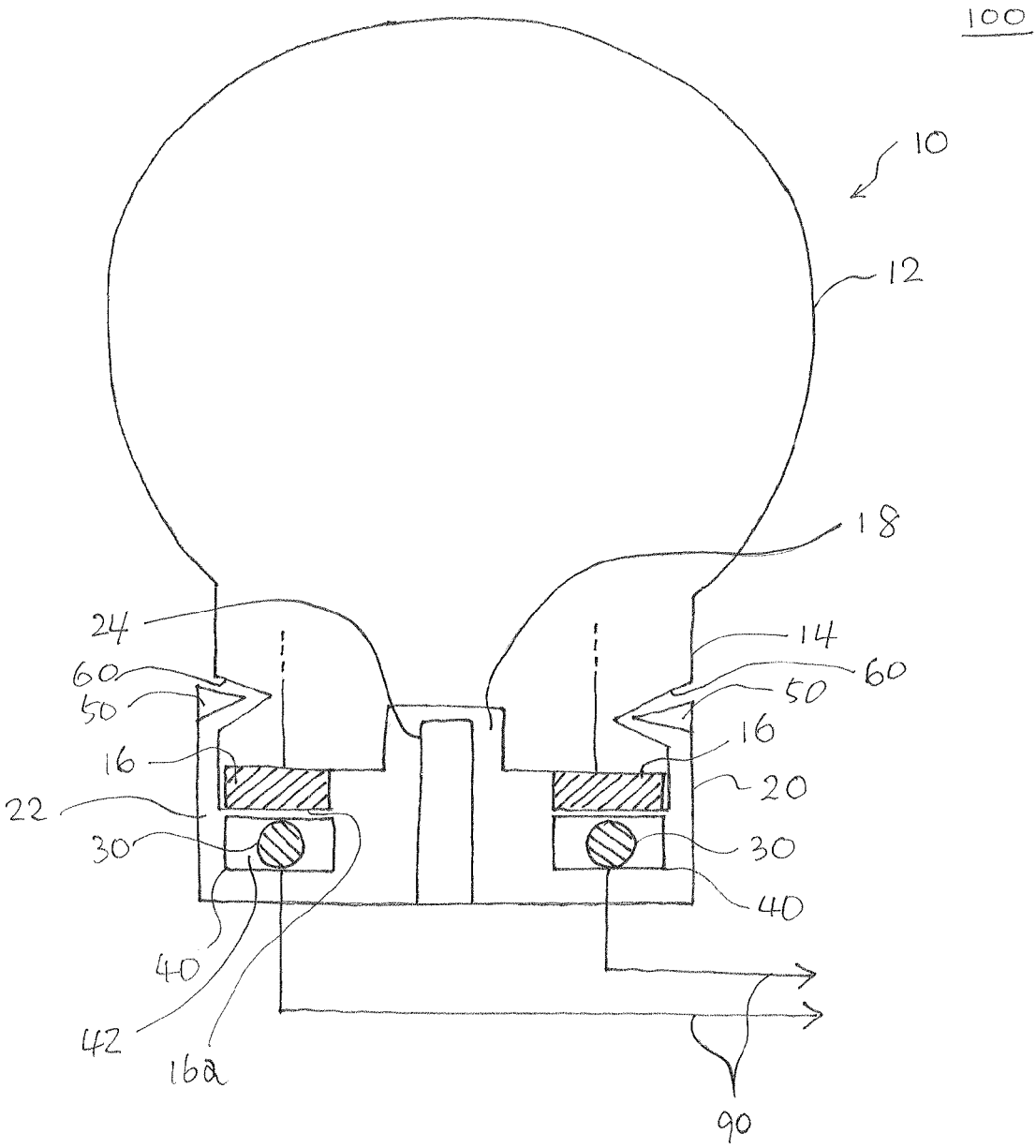
FIG. 1 is a cross-sectional front view of a lamp device according to an embodiment of the invention.

FIG. 1 shows a lamp device according to embodiments of the invention, and FIGS. 2-12 show different aspects of the invention.

An aspect of the invention provides a lamp device 100 comprising a lamp 10, a socket 20, two magnetic electrodes 30, and two electrode boxes 40.

The lamp 10 comprises a bulb portion 12, a stem portion 14, and two magnetic contacts 16.

The socket 20 has a receptacle portion 22 configured to accept the lamp 10.

The two magnetic electrodes 30 are disposed in the receptacle portion 22. The two magnetic electrodes 30 are fixed to the receptacle portion 22. Even though the fixing is not shown in the schematic cross-sectional view, they are fixed to each other to form one body which can accept and hold the lamp 10.

Each of the two electrode boxes 40 encloses each of the two magnetic electrodes 30. The magnetic electrode 30 is free to move in the electrode box 40, and the magnetic electrode 30 makes an electrical contact all the time. In order for the magnetic electrode 30 moves freely in the electrode box 40 under gravity and/or magnetic force, the magnetic electrode 30 may have a shape of ball, ellipsoid, or pebble-shape object having smooth edges. Of course, the shape is not limited to the above. Cube, disc, or other shapes are also possible.

The lamp device 100 may further comprise a guiding groove 18 and an insulating wall 24.

The guiding groove 18 may be provided on a bottom surface of the lamp 10 between the two magnetic contacts 16.

The insulating wall 24 may be disposed in a central position of the socket 20 between the two magnetic electrodes 30 and configured to fit into the guiding groove 18.

The guiding groove 18 may divide the bottom surface or inner space of the socket 20 into two portions from an edge to other edge.

Each of the two magnetic contacts 16 may comprise a contacting surface **16*a* fitting the corresponding one of the two electrode boxes 40** so as to facilitate electrical contact in-between.

Each of the two electrode boxes 40 may comprise a flat space 42 having an even height such that the magnetic electrode 30 may move around freely.

Each of the two magnetic electrodes 30 may have a height smaller than the height of the flat space 42 in the electrode box 40.

The lamp device 100 may further comprise two power lines 90, and each of the two power lines 90 may be electrically connected to corresponding one of two electrode boxes 40.

Alternatively, each of the two power lines 90 may be electrically connected to corresponding one of two magnetic electrodes 30. In such a case, the connection is configured so as not to interfere the movement of the magnetic electrode 30.

Figure 4:
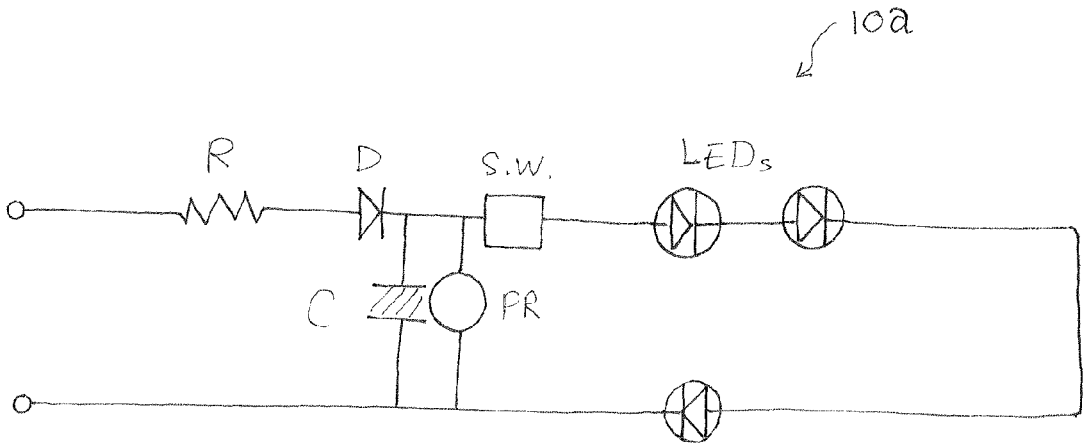
FIG. 4 is a schematic circuit diagram of a lamp according to an embodiment of the invention.

In certain embodiment, the lamp device 100 may be operated by alternating voltage as in FIG. 4. Still in another embodiments of the invention, the lamp device 100 may be operated by direct voltage. In Such case, the polarity of the two magnetic contacts 16 of the lamp 10 and the two magnetic electrodes 30 may be determined so as to provide a voltage of a predetermined polarity to the lamp 10.

Each of the two electrode boxes 40 may be non-magnetic and electrically conductive.

Alternatively, each of the two electrode boxes 40 may be ferromagnetic and electrically conductive.

Figure 5:
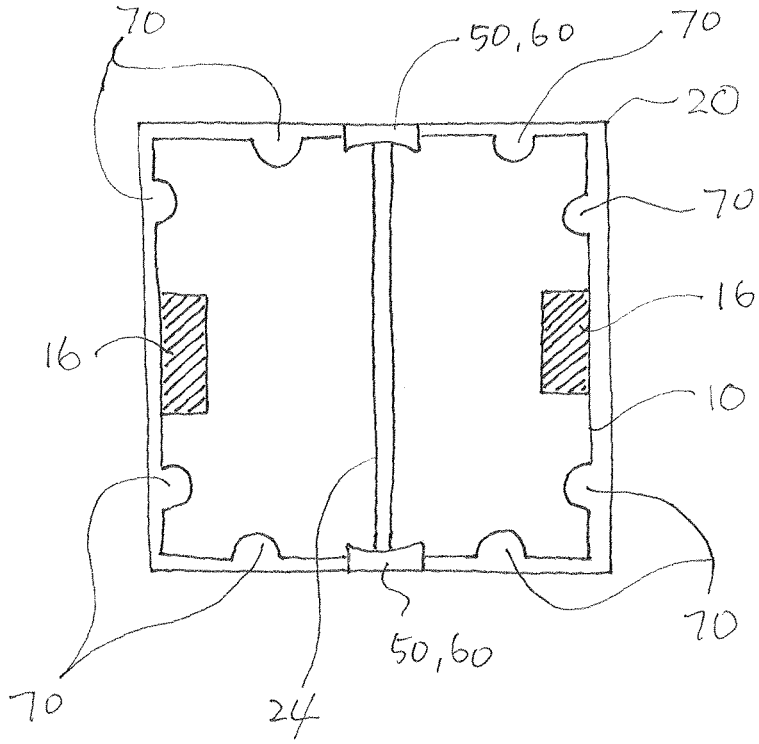
FIG. 5 is a cross-sectional bottom view of a lamp device according to another embodiment of the invention.
Figure 6:
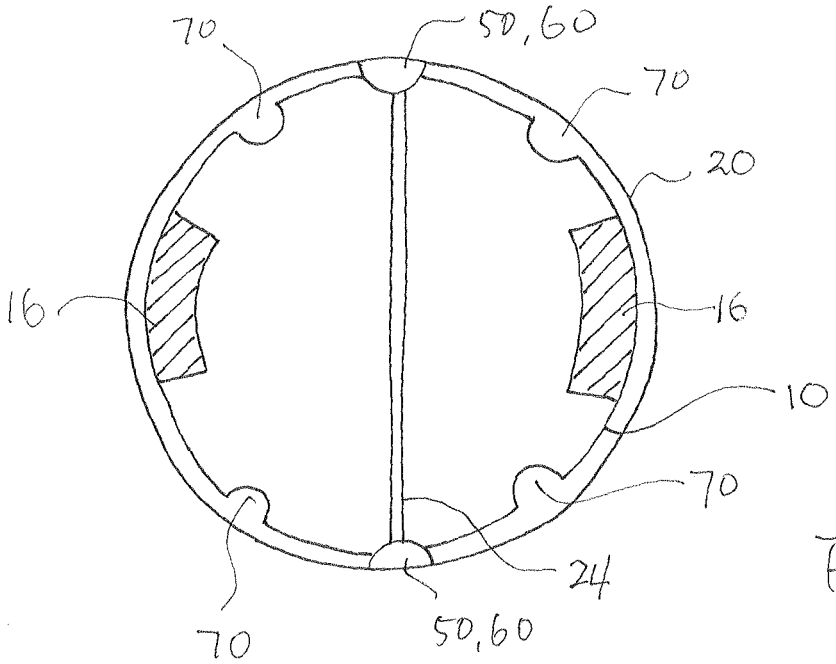
FIG. 6 is a cross-sectional bottom view of a lamp device according to still another embodiment of the invention.

The lamp device 100 may further comprise one or more male and female locking devices 50, 60 as shown in FIGS. 1, 5, and 6.

The one or more male locking devices 50 may be provided in an inner wall of the receptacle portion 22.

The one or more female locking devices 60 may be provided on side wall of the lamp 10.

The lamp 10 may further comprise one or more ventilation holes 70 along contacting surface between the socket 20 as shown in FIGS. 5 and 6. The ventilation holes 70 can have any shape and size. For some lamps of low power, there is no need of them.

The stem portion 14 of the lamp 10 and the socket 20 may be circular in cross-section as shown in FIG. 6.

Alternatively, the stem portion 14 of the lamp 10 and the socket 20 may be rectangular in cross-section as shown in FIG. 5. Of course, the cross-sectional shape of them are not limited to the above.

Figure 10:
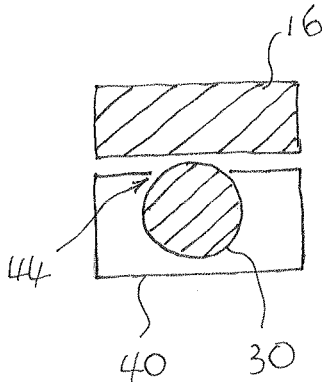

Each of the two electrode boxes 40 may further comprise an opening 44 provided on a portion of surface of the electrode box 40 for facilitating attraction and contact between the corresponding magnetic electrode 30 and magnetic contacts 16 as shown in FIG. 10.

Figure 8:
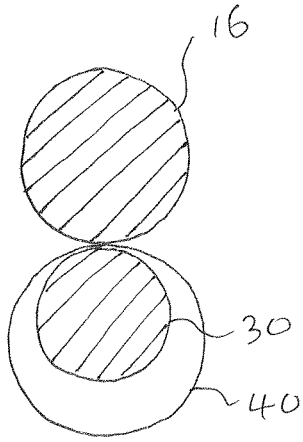
Figure 9:
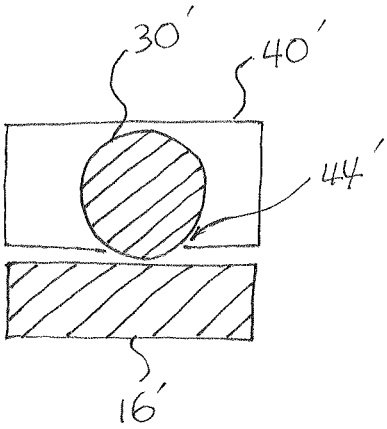

In certain embodiment, each of the two electrode boxes 40 may have a shape of shell, and each of the two magnetic contacts 30 may have a shape of sphere as shown in FIG. 8.

Figure 3:
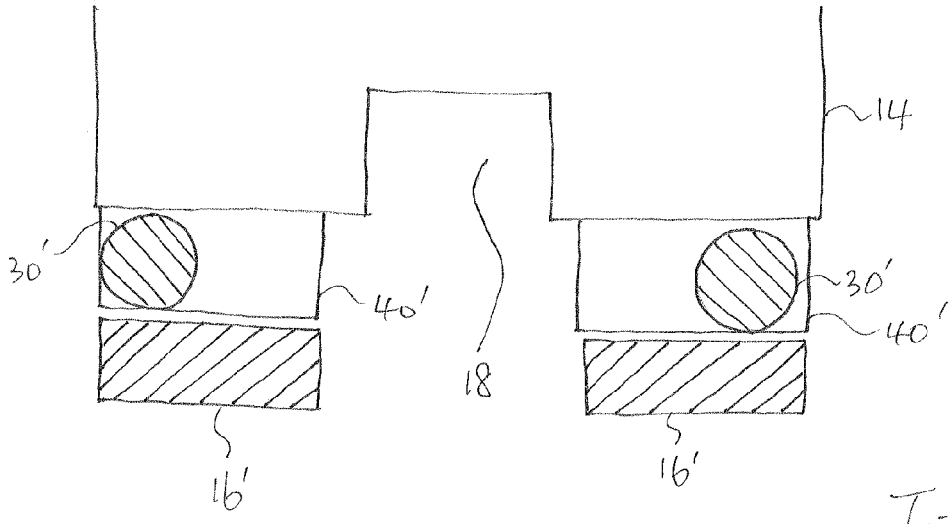
FIG. 3 is a partial cross-sectional view of a lamp device according to an embodiment of the invention.
Figure 7:
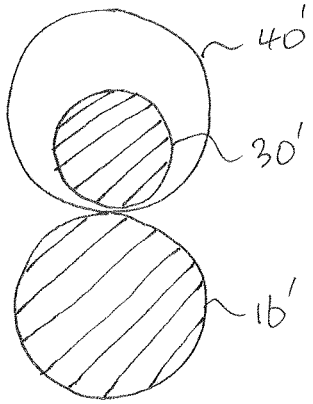
FIGS. 7-12 is a cross-sectional view of electrode portions of a lamp device according to still another embodiment of the invention.

Another aspect of the invention provides a lamp device 100 with magnetic socket comprising a lamp 10, two electrode boxes 40', two magnetic balls 30', a socket 20, and two magnetic contacts 16' as shown in FIGS. 3 and 7.

The two electrode boxes 40' are provided on a bottom surface of the stem portion of the lamp 10.

Each of the two magnetic electrode balls 30' is disposed movably in a corresponding electrode box 40'. The magnetic electrode balls 30' is free to move in the electrode box 40', and the magnetic electrode ball 30' makes an electrical contact with the electrode box 40' all the time.

The two magnetic contacts 16' are provided in the receptacle portion 22 of the socket 20.

The insulating wall 24 may be disposed in a central position between the two magnetic contacts 16' and configured to fit into the guiding groove 18.

Figure 11:
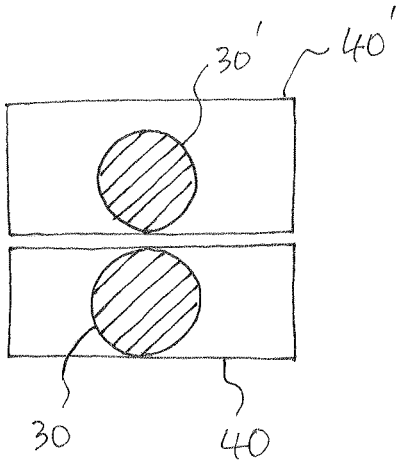
Figure 12:
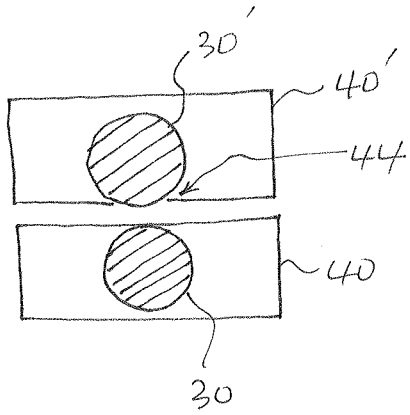

Still another aspect of the invention in FIG. 11 provides a lamp device 100 with magnetic socket comprising:

two first electrode boxes 40' provided on a bottom surface of the stem portion 14 of the lamp 10;

two first magnetic electrode balls 30', each of which being disposed movably in a corresponding first electrode box 40', wherein the first magnetic electrode ball 30' is free to move in the first electrode box 40', wherein the first magnetic electrode ball 30' makes an electrical contact with the first electrode box 40' all the time;

two second electrode boxes 40 provided in the receptacle portion 22 of the socket 20; and two second magnetic electrode balls 30, each of which being disposed movably in a corresponding second electrode box 40, wherein the second magnetic electrode ball 30 is free to move in the second electrode box 40, wherein the second magnetic electrode ball 30 makes an electrical contact with the second electrode box 40 all the time.

One of the first and second electrode boxes 40, 40' may comprise an opening 44, 44' provided on a portion of the surface of the electrode box 40, 40'.

Figure 2:
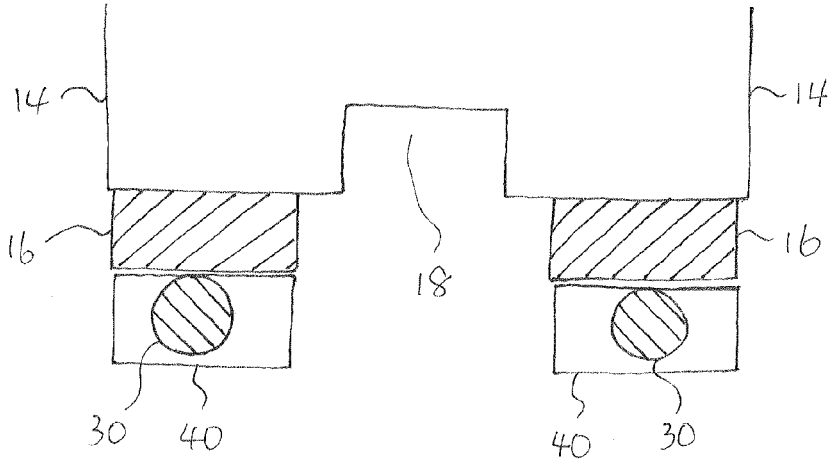
FIG. 2 is a partial cross-sectional view showing electrode portions of FIG. 1.

FIGS. 2 and 3 show two embodiments in which only the electrode portions are switched between the lamp 10 and the socket 20. The same things happen in FIGS. 9 and 10 and FIGS. 11 and 12.

The circuit diagram in FIG. 4 show an example of inside of the bulb portion 12 of the lamp 10. In the illustrated embodiment, a plurality of LEDs form the lamp 10. Also, the circuit is FIG. 4 includes a rectifier for converting AC to DC comprising a resistor, a capacitor, and diode. The circuit also includes a switch and a photo resistor for automatic on-off operation according to the ambient light. Of course, the lamp device 100 of the invention may be connected directly to a DC power supply (now shown).

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A lamp device with magnetic socket comprising:

a lamp comprising a bulb portion, a stem portion, and two magnetic contacts;

a socket having a receptacle portion configured to accept the lamp;

two magnetic electrodes disposed in the receptacle portion; and two electrode boxes, each of which enclosing each of the two magnetic electrodes, wherein the magnetic electrode is free to move in the electrode box, wherein the magnetic electrode makes an electrical contact all the time.

2. The lamp device of claim 1, further comprising:

a guiding groove provided on a bottom surface of the lamp between the two magnetic contacts;

an insulating wall disposed in a central position between the two magnetic electrodes and configured to fit into the guiding groove, wherein the guiding groove divides the bottom surface into two portions from an edge to other edge.

3. The lamp device of claim 1, wherein each of the two magnetic contacts comprises a contacting surface fitting the corresponding one of the two electrode boxes so as to facilitate electrical contact in-between.

4. The lamp device of claim 1, wherein each of the two electrode boxes comprises a flat space having an even height.

5. The lamp device of claim 4, wherein each of the two magnetic electrodes has a height smaller than the height of the flat space in the electrode box.

6. The lamp device of claim 5, further comprising two power lines, wherein each of the two power lines is electrically connected to corresponding one of two electrode boxes.

7. The lamp device of claim 5, further comprising two power lines, wherein each of the two power lines is electrically connected to corresponding one of two magnetic electrodes.

8. The lamp device of claim 4, wherein the polarity of the two magnetic contacts of the lamp and the two magnetic electrodes are determined so as to provide a voltage of a predetermined polarity to the lamp.

9. The lamp device of claim 1, wherein each of the two electrode boxes is non-magnetic and electrically conductive.

10. The lamp device of claim 1, wherein each of the two electrode boxes is ferromagnetic and electrically conductive.

11. The lamp device of claim 1, further comprising:

one or more male locking devices provided in an inner wall of the receptacle portion; and one or more female locking devices provided on side wall of the lamp.

12. The lamp device of claim 1, wherein the lamp further comprises one or more ventilation holes along contacting surface between the socket.

13. The lamp device of claim 12, wherein the stem portion of the lamp and the socket are circular in cross-section.

14. The lamp device of claim 12, wherein the stem portion of the lamp and the socket are rectangular in cross-section.

15. The lamp device of claim 1, wherein each of the two electrode boxes further comprises an opening provided on a portion of surface of the electrode box for facilitating attraction and contact between the corresponding magnetic electrode and magnetic contacts.

16. The lamp device of claim 1, wherein each of the two electrode boxes has a shape of shell, and wherein each of the two magnetic contacts has a shape of sphere.

17. A lamp device with magnetic socket comprising:

a lamp comprising a bulb portion and a stem portion;

two electrode boxes provided on a bottom surface of the stem portion of the lamp;

two magnetic electrode balls, each of which being disposed movably in a corresponding electrode box, wherein the magnetic electrode ball is free to move in the electrode box, wherein the magnetic electrode ball makes an electrical contact with the electrode box all the time;

a socket having a receptacle portion configured to accept the lamp; and two magnetic contacts provided in the receptacle portion of the socket.

18. The lamp device of claim 17, further comprising:

a guiding groove provided on a bottom surface of the stem portion between the two electrode boxes; and an insulating wall disposed in a central position between the two magnetic contacts and configured to fit into the guiding groove.

19. A lamp device with magnetic socket comprising:

a lamp comprising a bulb portion and a stem portion;

two first electrode boxes provided on a bottom surface of the stem portion of the lamp;

two first magnetic electrode balls, each of which being disposed movably in a corresponding first electrode box, wherein the first magnetic electrode ball is free to move in the first electrode box, wherein the first magnetic electrode ball makes an electrical contact with the first electrode box all the time;

a socket having a receptacle portion configured to accept the lamp; and two second electrode boxes provided in the receptacle portion of the socket; and two second magnetic electrode balls, each of which being disposed movably in a corresponding second electrode box, wherein the second magnetic electrode ball is free to move in the second electrode box, wherein the second magnetic electrode ball makes an electrical contact with the second electrode box all the time.

20. The lamp device of claim 19, wherein one of the first and second electrode boxes comprises an opening provided on a portion of the surface of the electrode box.

* * * * *